US012616302B2

(12) United States Patent
Cao et al.

(10) Patent No.: US 12,616,302 B2
(45) Date of Patent: May 5, 2026

(54) COUPLING MECHANISM AND SEATING FURNITURE

(71) Applicant: JASON FURNITURE (HANGZHOU) CO., LTD., Hangzhou (CN)

(72) Inventors: Jizhong Cao, Hangzhou (CN); Yuanfeng Feng, Hangzhou (CN); Jundong Gao, Hangzhou (CN); Qingke Kong, Hangzhou (CN); Yun Su, Hangzhou (CN)

(73) Assignee: JASON FURNITURE (HANGZHOU) CO., LTD., Hangzhou (CN)

( * ) Notice: Subject to any disclaimer, the term of this patent is extended or adjusted under 35 U.S.C. 154(b) by 162 days.

(21) Appl. No.: 18/400,378

(22) Filed: Dec. 29, 2023

(65) Prior Publication Data

US 2025/0024946 A1 Jan. 23, 2025

(30) Foreign Application Priority Data

Jul. 22, 2023 (CN) ..... 202310908540.9

(51) Int. Cl.
*A47C 1/034* (2006.01)
*A47C 1/032* (2006.01)
*A47C 1/0355* (2013.01)

(52) U.S. Cl.
CPC ..... *A47C 1/0355* (2013.01)

(58) Field of Classification Search
CPC ..... A47C 1/0355; A47C 1/0352; A47C 7/506; A47C 1/032; A47C 1/03211; A47C 1/0342; A47C 1/035; A47C 7/5068
(Continued)

(56) References Cited

U.S. PATENT DOCUMENTS 3,099,487 A * 7/1963 Knabusch ..... A47C 1/0345 297/423.26
3,300,244 A * 1/1967 Hughes ..... A47C 1/0355 297/89

(Continued)

FOREIGN PATENT DOCUMENTS

CN 102885501 A 1/2013
CN 203058972 U 7/2013

(Continued)

OTHER PUBLICATIONS

Office Action received in corresponding Chinese patent application No. 202310908540.9, dated Apr. 10, 2025, 17 pages.

(Continued)

*Primary Examiner* — Shin H Kim
(74) *Attorney, Agent, or Firm* — Cooper Legal Group, LLC

(57) ABSTRACT

A coupling mechanism includes a seat frame; a leg rest; a backrest bracket; a carriage slidably connected to the seat frame; a linkage assembly for backrest connected to the backrest bracket, the seat frame and the carriage; a linkage mechanism for leg rest connected to the carriage and the leg rest, so that the leg rest can move toward or away from the carriage; a coupling assembly rotationally connected to the carriage, two ends of the coupling assembly are respectively articulated to the seat frame and the linkage mechanism for leg rest; a drive assembly connected to the carriage, to drive the leg rest and the backrest bracket to move relative to the seat frame; wherein during operation of the drive assembly, the carriage slides relative to the seat frame, and the leg rest and the backrest bracket move and rotate relative to the seat frame.

14 Claims, 11 Drawing Sheets

(58) Field of Classification Search
USPC ..... 297/68, 69
See application file for complete search history.

(56) References Cited

U.S. PATENT DOCUMENTS

| | | | | |
|---|---|---|---|---|
| 5,186,518 | A * | 2/1993 | Pine | A47C 1/0355 297/85 L |
| 5,823,614 | A | 10/1998 | Johnson et al. | |
| 7,695,059 | B1 * | 4/2010 | May | A47C 7/50 297/423.26 |
| 8,419,122 | B2 * | 4/2013 | Lawson | A47C 1/035 297/259.2 |
| 9,398,810 | B2 * | 7/2016 | Donovan | A47C 1/0342 |
| 11,744,369 | B2 * | 9/2023 | Murphy | A47C 1/03211 297/69 |
| 12,232,617 | B2 * | 2/2025 | Yang | A47C 1/0355 |
| 2009/0256402 | A1 | 10/2009 | Smith | |
| 2012/0193946 | A1 * | 8/2012 | Robertson | A47C 1/03294 5/613 |
| 2013/0175847 | A1 * | 7/2013 | Lawson | A61G 5/14 297/85 M |
| 2015/0054316 | A1 * | 2/2015 | Donovan | A47C 1/0342 297/313 |
| 2015/0272329 | A1 * | 10/2015 | Lawson | A47C 1/0355 297/342 |
| 2016/0100686 | A1 * | 4/2016 | Regev | A47C 7/5068 297/270.1 |
| 2017/0143122 | A1 | 5/2017 | Nelson et al. | |
| 2018/0352960 | A1 | 12/2018 | Carrera | |
| 2019/0350362 | A1 * | 11/2019 | Lapointe | A47C 7/506 |
| 2020/0163458 | A1 * | 5/2020 | Murphy | A47C 1/0355 |
| 2022/0361674 | A1 | 11/2022 | Li et al. | |
| 2024/0365982 | A1 * | 11/2024 | LaPointe | A47C 1/02 |
| 2025/0024946 | A1 * | 1/2025 | Cao | A47C 1/03211 |

FOREIGN PATENT DOCUMENTS

| | | | |
|---|---|---|---|
| CN | 107949303 | A | 4/2018 |
| CN | 110623452 | A | 12/2019 |
| CN | 216316674 | U | 4/2022 |
| CN | 218605843 | U | 3/2023 |
| CN | 219071109 | U | 5/2023 |
| CN | 220477266 | U | 2/2024 |
| DE | 3853149 | T2 | 10/1995 |
| DE | 102012204670 | A1 | 9/2013 |
| WO | 2018212987 | A1 | 11/2018 |

OTHER PUBLICATIONS

Second Office Action received in corresponding Chinese patent application No. 202310908540.9, dated Oct. 14, 2025, 19 pages.

* cited by examiner

COUPLING MECHANISM AND SEATING FURNITURE

CROSS-REFERENCE TO RELATED APPLICATION

This application claims the priority and benefit of Chinese patent application serial no. 202310908540.9, filed on Jul. 22, 2023. The entirety of Chinese patent application serial no. 202310908540.9 is hereby incorporated by reference herein and made a part of this specification.

TECHNICAL FIELD

The present disclosure relates to the field of home furnishing, and in particular, to a coupling mechanism and a seating furniture.

BACKGROUND ART

With the development of the home furnishing industry, people have more and more requirements for the function of the seating furniture. In current sofas with function adjustment, a synchronous extension and retraction movement of the backrest and the leg rest of the sofa cannot be realized through a single drive source, in particular, only one of the backrest and the leg rest can be driven firstly and then the other, a synchronous extension and retraction is impossible. If the synchronous extension and retraction of the backrest and the leg rest of the sofa should be realized, the backrest and the leg rest must be respectively configured with a drive source, such that two drive sources are controlled by a switch to enable a synchronous extension and retraction of the backrest and leg rest, which means an additional drive source must be provided, thereby increasing the cost of a sofa.

SUMMARY

In order to solve the above technical problems, a coupling mechanism and a seating furniture are provided, in which the leg rest and the backrest bracket are synchronously driven to extend and retract synchronously by means of a single drive source, thereby obtaining a simple structure and reducing the product cost.

In the first aspect, a coupling mechanism is provided, including a seat frame, a leg rest and a backrest bracket, the coupling mechanism further includes:

- a carriage slidably connected to the seat frame;
- a linkage assembly for backrest, which is connected to the backrest bracket, the seat frame and the carriage, so that the backrest bracket is coupled to the carriage, so as to move relative to the seat frame;
- a linkage mechanism for leg rest, which is connected to the carriage and the leg rest, so that the leg rest is able to move toward or away from the carriage;
- a coupling assembly rotationally connected to the carriage, two ends of the coupling assembly are respectively articulated to the seat frame and the linkage mechanism for leg rest;
- a drive assembly connected to the carriage, to drive the leg rest and the backrest bracket to move relative to the seat frame;
- wherein during operation of the drive assembly, the carriage slides relative to the seat frame, and the leg rest as well as the backrest bracket move and rotate relative to the seat frame.

According to the above technical solution, the carriage and the coupling assembly connect the linkage mechanism for leg rest and the linkage assembly for backrest. The linkage mechanism for leg rest is connected to the leg rest while the linkage assembly for backrest is connected to the backrest bracket, so that the leg rest and the backrest bracket can be driven by a single drive source to retract and extend synchronously, as a result of which a smooth posture adjustment is achieved and the staccato feel of the traditional sofa adjustment is changed.

In a further approach in combination with the first aspect, the drive assembly is arranged between the carriage and the seat frame, the drive assembly is configured to drive the carriage to move relative to the seat frame, and the leg rest and the backrest bracket are driven to move and rotate relative to the seat frame through the linkage mechanism for leg rest, the coupling assembly and the linkage assembly for backrest during the movement of the carriage.

According to the above technical solution, the drive assembly is arranged between the carriage and the seat frame. The carriage is driven to move relative to the seat frame, so that the linkage mechanism for leg rest, the coupling assembly and the linkage assembly for backrest are driven to move synchronously, so that the leg rest and the backrest bracket can extend and retract synchronously.

In a further approach in combination with the first aspect, the drive assembly is arranged between the carriage and the linkage mechanism for leg rest, the drive assembly is configured to drive the linkage mechanism for leg rest to rotate relative to the carriage, and during the rotation of the linkage mechanism for leg rest and by means of the coupling assembly and the linkage assembly for backrest, the carriage is driven to move relative to the seat frame, meanwhile the leg rest and the backrest bracket are driven to move and rotate relative to the seat frame.

According to the above technical solution, the drive assembly is arranged between the carriage and the linkage mechanism for leg rest. The linkage mechanism for leg rest is driven to move, so that the coupling assembly is driven to move, and the coupling assembly in turn brings the carriage into a movement relative to the seat frame, so that the linkage assembly for backrest is driven to rotate, so that the leg rest and the backrest bracket can extend and retract synchronously.

In a further approach in combination with the first aspect, the linkage assembly for backrest comprises a first linkage for backrest, a second linkage for backrest and a third linkage for backrest, two ends of the first linkage for backrest are respectively articulated to the backrest bracket and the seat frame, two ends of the second linkage for backrest are also respectively articulated to the backrest bracket and the seat frame, two ends of the third linkage for backrest are respectively articulated to the second linkage for backrest and the carriage, and the first linkage for backrest, the backrest bracket, the second linkage for backrest and the seat frame are articulated to each other to form a planar four-bar linkage.

According to the above technical solution, the coupling of the second linkage for backrest to the carriage is established through the third linkage for backrest. The first linkage for backrest, the backrest bracket, the second linkage for backrest and the seat frame are articulated to each other to form a double-rocker mechanism of a planar four-bar linkage, whereby the backrest bracket can synchronously move and rotate along with the carriage.

In a further approach in combination with the first aspect, the coupling assembly comprises a first coupling rod, a second coupling rod and a third coupling rod, the second coupling rod is articulated to the carriage, two ends of the second coupling rod are respectively articulated to the first coupling rod and the third coupling rod, an end of the first coupling rod facing away from the second coupling rod is articulated to the linkage assembly for backrest, and an end of the third coupling rod facing away from the second coupling rod is articulated to the linkage mechanism for leg rest.

According to the above technical solution, the hinge joint of the second coupling rod to the carriage enable the second coupling rod to rotate relative to the carriage while it moves along with the carriage. The second coupling rod drives the linkage assembly for backrest to move through the first coupling rod, and drives the linkage mechanism for leg rest to move through the third coupling rod, so that the leg rest and the backrest bracket extends and retracts synchronously.

In a further approach in combination with the first aspect, the linkage mechanism for leg rest comprises a linkage assembly for leg rest, a holder and a connecting rod, two ends of the linkage assembly for leg rest are respectively articulated to the carriage and the holder, the leg rest is articulated to the linkage assembly for leg rest, and two ends of the connecting rod are respectively articulated to the holder and the leg rest.

According to the above technical solution, the linkage assembly for leg rest can bring the leg rest into a synchronous movement. The holder and the connecting rod drive the leg rest to rotate relative to the linkage assembly for leg rest as they move along with the linkage assembly for leg rest. In this way, the leg rest can move toward or away from the carriage, while it rotates relative to the linkage assembly for leg rest, thereby better supporting the legs of the user.

In a further approach in combination with the first aspect, the linkage assembly for leg rest comprises a first linkage for leg rest, a second linkage for leg rest, a third linkage for leg rest and a fourth linkage for leg rest, a first end of the first linkage for leg rest is articulated to the carriage, while a second end of the first linkage for leg rest is articulated to the second linkage for leg rest, an end of the second linkage for leg rest facing away from the first linkage for leg rest is articulated to an end of the leg rest at a first hinge point, a first end of the third linkage for leg rest is articulated to the carriage, while a second end of the third linkage for leg rest is articulated to the fourth linkage for leg rest, an end of the fourth linkage for leg rest facing away from the third linkage for leg rest is articulated to the holder, and the fourth linkage for leg rest is articulated at a point between its two ends to a point between two ends of the first linkage for leg rest.

According to the above technical solution, while the leg rest moves towards or away from the carriage through the connecting structure of the first linkage for leg rest, the second linkage for leg rest, the third linkage for leg rest and the fourth linkage for leg rest, the leg rest can also rotate relative to the carriage, so that the leg rest can move away from or towards the carriage and be stored below the carriage.

In a further approach in combination with the first aspect, the holder is further articulated to the second linkage for leg rest at a second hinge point, the second hinge point is close to the first hinge point between the leg rest and the second linkage for leg rest, a third hinge point between the connecting rod and the leg rest is close to the first hinge point between the leg rest and the second linkage for leg rest, and the holder, the connecting rod, the leg rest and the second linkage for leg rest are articulated to each other to form a planar four-bar linkage.

According to the above technical solution, the holder is respectively articulated to the second linkage for leg rest and the fourth linkage for leg rest, therefore, the holder can rotate relative to the linkage assembly for leg rest when it moves along with the linkage assembly for leg rest, whereby it assists the leg rest to support legs of the user. The second hinge point between the holder and the second linkage for leg rest is close to the first hinge point between the leg rest and the second linkage for leg rest. The third hinge point between the connecting rod and the leg rest is close to the first hinge point between the leg rest and the second linkage for leg rest. The holder, the connecting rod, the leg rest and the second linkage for leg rest are articulated to each other to form a planar four-bar linkage, whereby the supporting surfaces of the leg rest and the holder can be substantially in one plane in a state in which the linkage assembly for leg rest is fully extended, to provide a planar support for the legs of the user and to increase the comfort of the leg support.

In a further approach in combination with the first aspect, the drive assembly comprises a driver and a drive rod, the driver is configured with a fixed end and a drive end, one of the fixed end and the drive end is connected to the carriage, while the other of the fixed end and the drive end is eccentrically articulated to the drive rod, and the drive rod is fixedly connected to the linkage mechanism for leg rest.

According to the above technical solution, the drive end of the driver can move telescopically relative to the fixed end, so as to bring the linkage mechanism for leg rest into a movement. The driver eccentrically drives the drive rod, so that the drive rod can rotate, and in turn the linkage mechanism for leg rest is driven to move because of the rotation of the drive rod, so that the leg rest and the backrest bracket can extend and retract synchronously.

In the second aspect, a seating furniture is provided, which includes a coupling mechanism according to the first aspect.

According to the above technical solution, the synchronous movement and rotation of the leg rest and the backrest bracket are achieved with a single drive source, which results in a simple structure and a low cost, and can also reduce the space requirement and the weight of the entire seating furniture.

In Summary, at Least One of the Following Advantageous Technical Effects is Achieved:

1. Through the coupling mechanism according to the present disclosure the conventional structure that the synchronous retraction and extension of the leg rest and the backrest bracket is achieved with a plurality of drive sources is changed. According to the present disclosure, the synchronous retraction and extension of the leg rest and the backrest bracket is achieved by a single drive source, so that the product has a simple structure, occupies a small space and is relatively light.
2. In the seating furniture according to the present disclosure, the synchronous movement and rotation of the leg rest and the backrest bracket is achieved by a single drive source, such that the drive program and structure are simpler, the costs are lower, and the space required and the weight of the entire seating furniture can be reduced.

DETAILED DESCRIPTION

Figure 1:
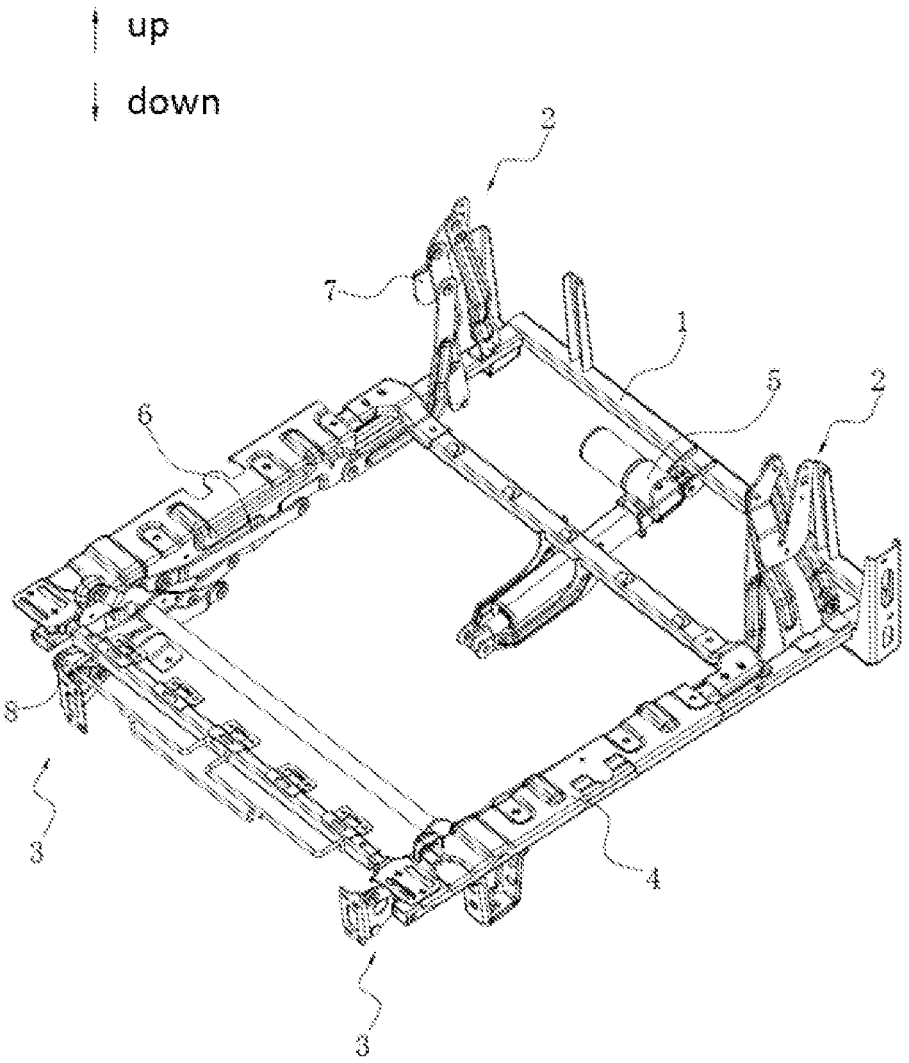
FIG. 1 shows schematically the structure of the coupling mechanism according to a first embodiment of the present disclosure in the sitting position.

For a better understanding of the purpose, technical solutions, and advantages of embodiments of the present application, the present application will be further described below in details in conjunction with the drawings. The assemblies of the embodiments of the present application typically described and shown in the drawings can be arranged and designed in various different configurations. Based on the embodiments in the present application, all other embodiments obtained by ordinary technicians in the art without creative labor fall within the scope of protection of the present application.

It should be noted that similar labels and letters represent similar terms in the drawings, and, once an item is defined in a figure, further definition and explanation are not required in subsequent figures.

In the description of the present application, it should be noted that, unless otherwise specified and limited, the terms "installation", "in connection with", and "connection" should be understood broadly, for example, they can be fixed connection, detachable connection, or integrated connection; or, alternatively, it can be a mechanical connection or an electrical connection; or, alternatively, it can be directly connected, or indirectly connected via an intermediate medium, or it can be internal communication between two components. For those skilled in the art, the specific meanings of the above terms in the present application can be understood in particular circumstances.

In the description of the present application, it should be understood that, the terms "up", "down", "left", "right", etc. indicate the orientation or positional relationship based on the orientation or positional relationship shown in the drawings, only for the convenience of describing the present application and simplifying the description, rather than indicating or implying that a device or component referred to must have a specific orientation, or be constructed and operated in a specific orientation, and therefore should not be understood as a limitation to the present application.

The following will provide a detailed explanation of some embodiments of the present application in conjunction with the drawings. Without conflict, the features in the following embodiments can be combined with each other.

The coupling mechanism of the conventional seating furniture includes two drivers. The two drivers drive the linkage assembly for backrest and the linkage mechanism for leg rest, respectively, to move the linkage assembly for backrest and the linkage mechanism for leg rest. A conventional seating furniture is usually a sofa or a lounge chair. When setting different postures, two drive mechanisms and control systems must be used. The structure is complex. The cost is high and the setting is cumbersome.

Embodiment 1

Figure 2:
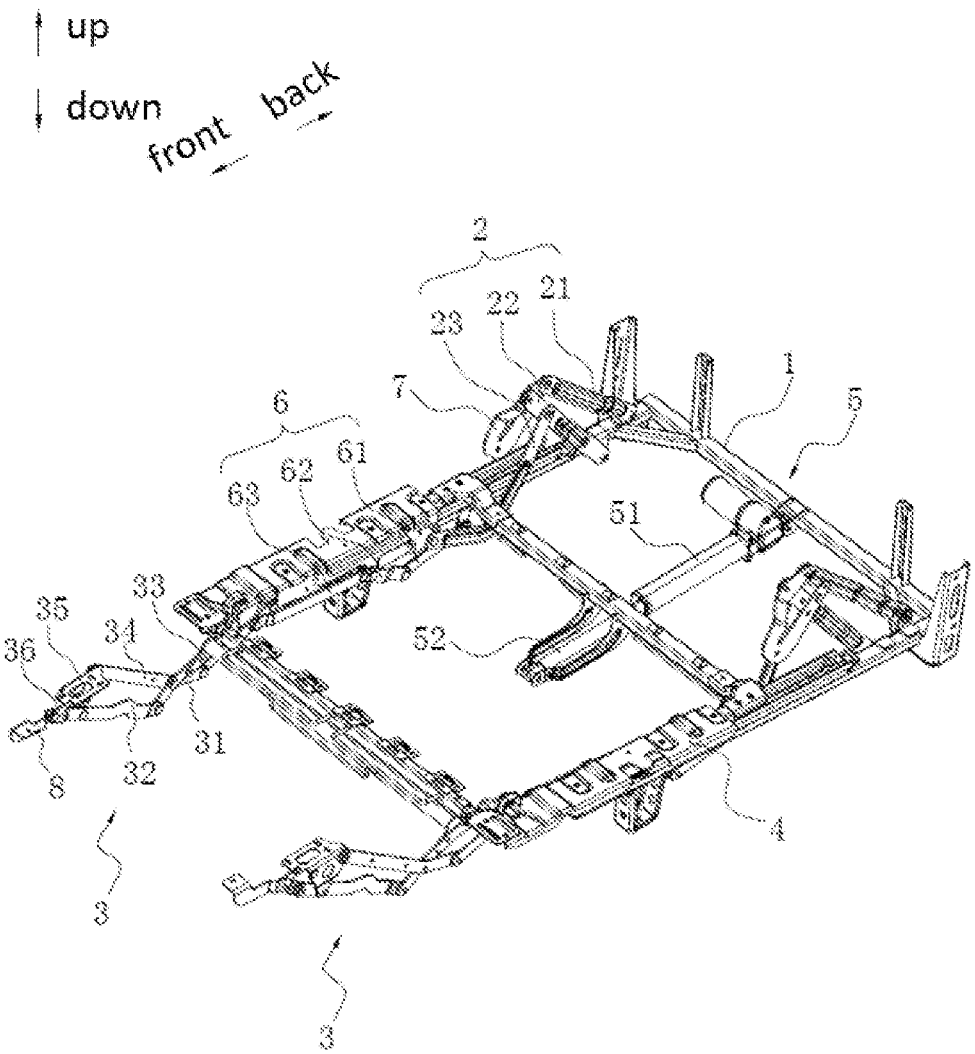
FIG. 2 shows schematically the structure of the coupling mechanism according to the first embodiment of the present disclosure in the lying position.
Figure 3:
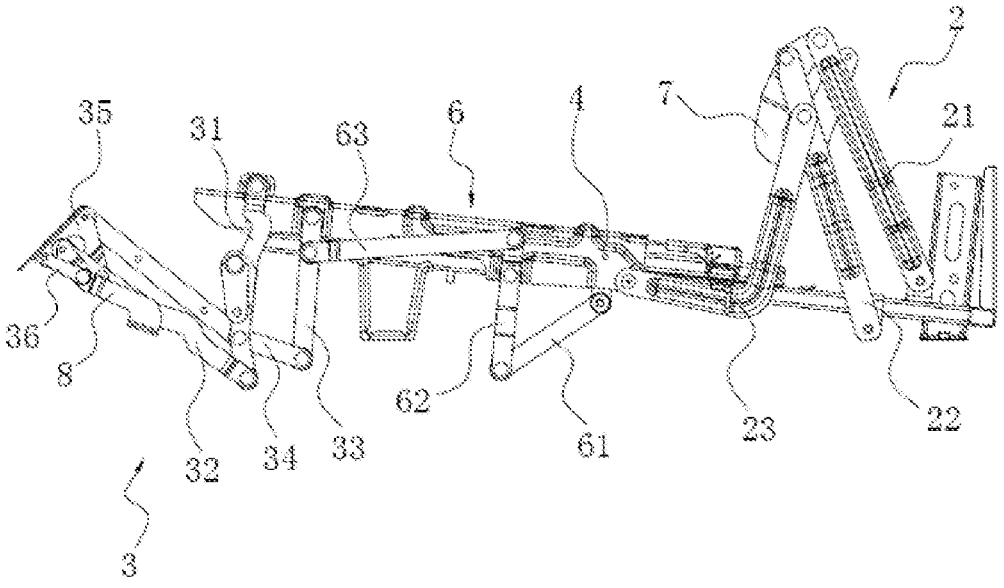
FIG. 3 shows schematically the structure of the coupling mechanism according to the first embodiment of the present disclosure in the intermediate position.

FIG. 1 to FIG. 3 schematically show the structure of an embodiment of the coupling mechanism.

The coupling mechanism can occupy a sitting position and a lying position. FIG. 1 shows schematically the structure of the coupling mechanism in the sitting position. The coupling mechanism includes a seat frame 1, a leg rest 8, a backrest bracket 7, a carriage 4, a linkage assembly for backrest 2, a linkage mechanism for leg rest 3, a coupling assembly 6 and a drive assembly. The carriage 4 is slidably connected to the seat frame 1. The linkage assembly for backrest 2 is connected to the backrest bracket 7, the seat frame 1 and the carriage 4, so that the backrest bracket 7 is coupled to the carriage 4, so as to move relative to the seat frame 1. The linkage mechanism for leg rest 3 is connected to the carriage 4 and the leg rest 8, so that the leg rest 8 moves toward or away from the carriage 4. The coupling assembly 6 is rotationally connected to the carriage 4, and two ends of the coupling assembly 6 are respectively articulated to the seat frame 1 and the linkage mechanism for leg rest 3. The drive assembly is connected to the carriage 4 to drive the leg rest 8 and the backrest bracket 7 to move relative to the seat frame 1. During operation of the drive assembly, the carriage 4 slides relative to the seat frame 1, and the leg rest 8 and the backrest bracket 7 move and rotate relative to the seat frame 1.

The drive assembly includes a driver 5. The driver 5 is arranged between the carriage 4 and the seat frame 1. The driver 5 is configured to drive the carriage 4, so that it moves relative to the seat frame 1. During the movement of the carriage 4, the leg rest 8 and backrest bracket 7 are driven to move and rotate relative to the seat frame 1 by means of the linkage mechanism for leg rest 3, the coupling assembly 6 and the linkage assembly for backrest 2. Depending on the function requirements of the product, the driver 5 can be configured as a linear motor, an electric push rod or other pneumatic or hydraulic drive mechanism.

In the sitting position, the linkage mechanism for leg rest 3 is retracted and located below the seat frame 1 and the carriage 4, while the linkage assembly for backrest 2 is folded, so that it is substantially perpendicular to the seat frame 1.

Referring to FIG. 2 and FIG. 3, the linkage assembly for backrest 2 includes a first linkage for backrest 21, a second linkage for backrest 22 and a third linkage for backrest 23. Two ends of the first linkage for backrest 21 are respectively articulated to the backrest bracket 7 and the seat frame 1, while two ends of the second linkage for backrest 22 are also respectively articulated to the backrest bracket 7 and the seat frame 1. Two ends of the third linkage for backrest 23 are respectively articulated to the second linkage for backrest 22 and the carriage 4. The first linkage for backrest 21, the backrest bracket 7, the second linkage for backrest 22 and the seat frame 1 are articulated to each other to form a planar four-bar linkage. The hinge point between the third linkage for backrest 23 and the second linkage for backrest 22 is at a position between two ends of the second linkage for backrest 22 and close to the hinge point between the second linkage for backrest 22 and the backrest bracket 7.

The coupling assembly 6 includes a first coupling rod 61, a second coupling rod 62 and a third coupling rod 63. The second coupling rod 62 is articulated to the carriage 4 at a position between two ends of the second coupling rod, and two ends of the second coupling rod 62 are respectively articulated to the first coupling rod 61 and the third coupling rod 63. The end of the first coupling rod 61 facing away from the second coupling rod 62 is articulated to the linkage assembly for backrest 2. The end of the third coupling rod 63 facing away from the second coupling rod 62 is articulated to the third linkage for leg rest 33 of the linkage mechanism for leg rest 3, whose hinge point is close to the hinge point between the third linkage for leg rest 33 and the carriage 4.

The linkage mechanism for leg rest 3 includes a linkage assembly for leg rest, a holder 35 and a connecting rod 36. The linkage assembly for leg rest includes a first linkage for leg rest 31, a second linkage for leg rest 32, a third linkage for leg rest 33 and a fourth linkage for leg rest 34. One end of the first linkage for leg rest 31 is articulated to the carriage 4, while the other end of the first linkage for leg rest is articulated to the second linkage for leg rest 32. The end of the second linkage for leg rest 32 facing away from the first linkage for leg rest 31 is articulated to an end of the leg rest 8. One end of the third linkage for leg rest 33 is articulated to the carriage 4, while the other end of the third linkage for leg rest is articulated to the fourth linkage for leg rest 34. The end of the fourth linkage for leg rest 34 departing away from the third linkage for leg rest 33 is articulated to the holder 35. A point at the fourth linkage for leg rest 34 between two ends thereof is articulated to a point at the first linkage for leg rest 31 between two ends thereof. The holder 35 is further articulated to the second linkage for leg rest 32, whose hinge point is close to the hinge point between the leg rest 8 and the second linkage for leg rest 32. The hinge point between the connecting rod 36 and the linkage for leg rest is close to the hinge point between the leg rest 8 and the second linkage for leg rest 32. The holder 35, the connecting rod 36, the leg rest 8 and the second linkage for leg rest 32 are articulated to each other to form a planar four-bar linkage.

While switching between the sitting position and the lying position, the driver 5 drives the carriage 4 to move relative to the seat frame 1. During the movement of the second coupling rod 62 through the carriage 4, the first coupling rod 61 pulls the second coupling rod 62 to rotate, the second coupling rod 62 pushes the third coupling rod 63 to move, and the third coupling rod 63 pushes the linkage mechanism for leg rest 3 to rotate upward and outward from its position below the seat frame 1. When the linkage mechanism for leg rest 3 moves, the holder 35 is driven to rotate by the third linkage for leg rest 33 and the second linkage for leg rest 32, at the same time, the leg rest 8 rotates relative to the second linkage for leg rest 32 under the joint action of the second linkage for leg rest 32, the holder 35 and the connecting rod.

FIG. 2 shows schematically the structure of the coupling mechanism according to the present disclosure in the lying position. In the lying position, the linkage mechanism for leg rest 3 rotates relative to the carriage 4 to move forward and upward away from the carriage 4, and the leg rest 8 rotates upwards relative to the second linkage for leg rest 32, until it lies approximately in the same plane as the holder 35. The linkage assembly for backrest 2 rotates relative to the seat frame 1 through the carriage 4. The backrest bracket 7 rotates from a state in which it is approximately perpendicular to the seat frame 1 to a state in which it inclines at an angle with the seat frame 1. The drive assembly includes a driver 5. In this embodiment, the driver 5 is an electric push rod. Depending on the design requirements, the electrical element can be a linear motor, a pneumatic driver 5 or a hydraulic driver 5. The driver 5 includes a fixed end 51 and a drive end 52. The fixed end 51 is provided with a drive motor, which can drive the drive end 52 to move linearly relative to the fixed end 51. In this embodiment, the fixed end 51 is connected to the seat frame 1, in particular, the drive end 52 is rotationally, in particular pivotally, connected to the carriage 4. According to the structural requirements, the fixed end 51 can be fixedly connected to the seat frame 1 or can be articulated to the seat frame 1, in this embodiment, is pivotally connected to the seat frame.

Referring to FIG. 3, there is an intermediate position between the sitting position and the lying position. In this state, the linkage mechanism for leg rest 3 is rotated upward and forward relative to the seat frame 1 at a certain angle, but not fully extended, while the leg rest 8 does not rotate relative to the second linkage for leg rest 32, and the leg rest 8 and the second linkage for leg rest 32 are in a folded state. When the linkage assembly for backrest 2 is rotated at an angle relative to the seat frame 1, the backrest bracket 7 is also rotated at an angle relative to the seat frame 1 through the linkage assembly for backrest 2. The first coupling rod 61, the second coupling rod 62 and the third coupling rod 63 of the coupling assembly 6 are articulated to each other to form a small Z-shape.

Embodiment 2

Figure 4:
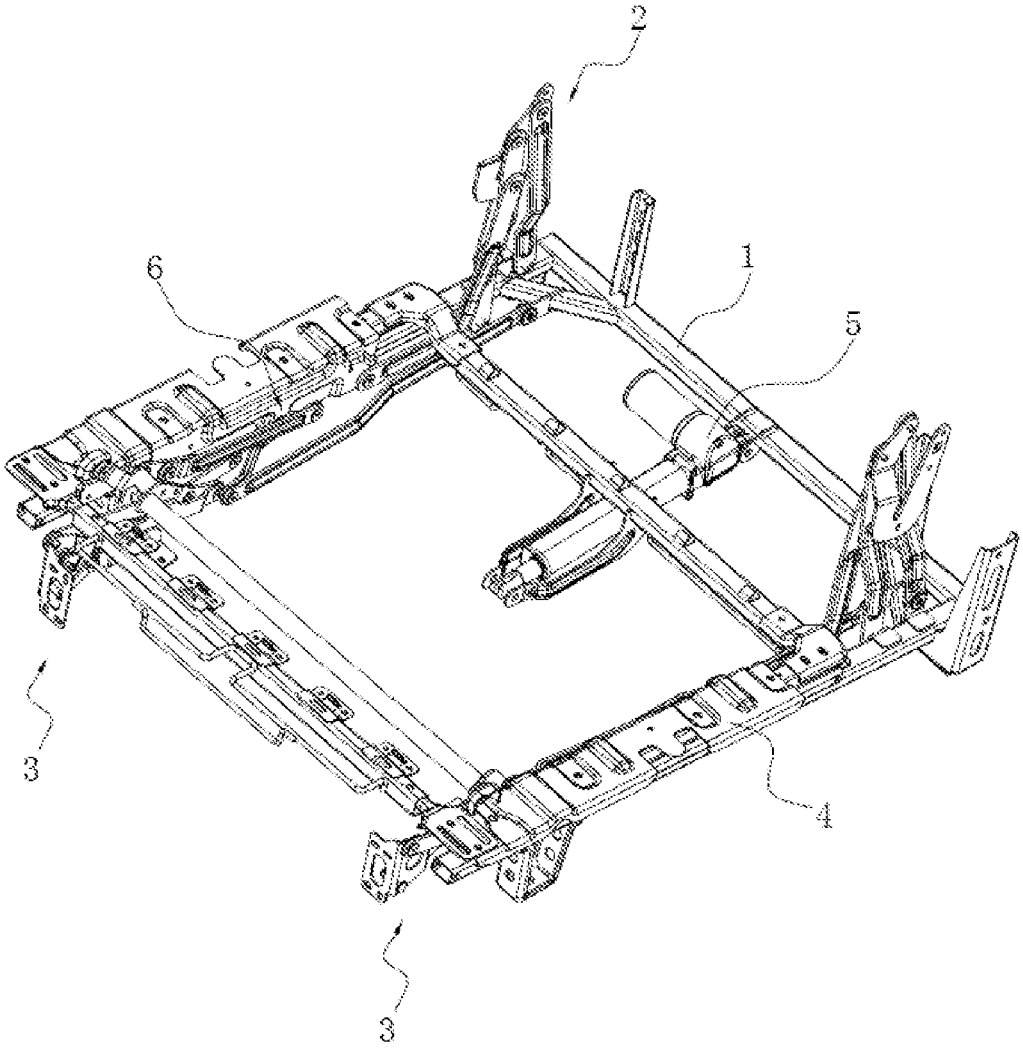
FIG. 4 shows schematically the structure of the coupling mechanism according to a second embodiment of the present disclosure in the sitting position.
Figure 5:
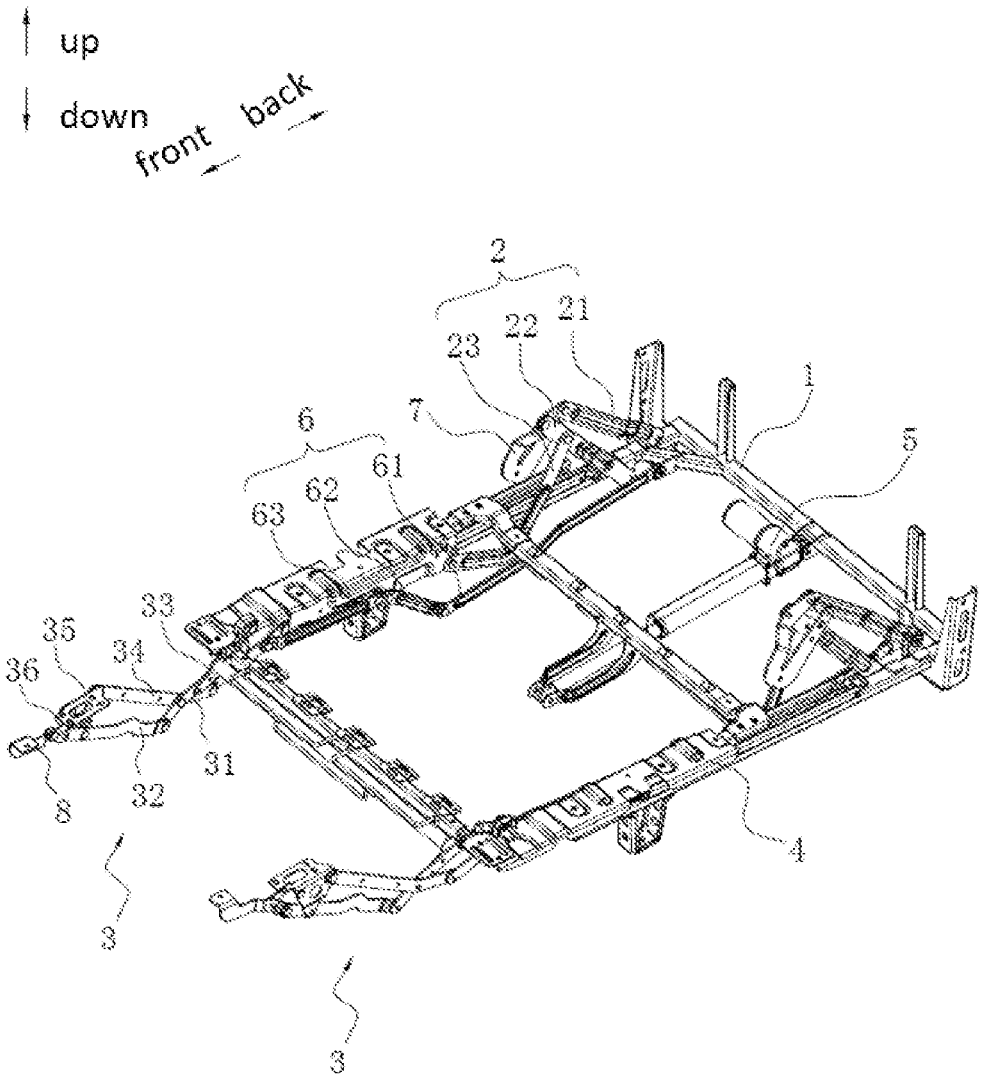
FIG. 5 shows schematically the structure of the coupling mechanism according to the second embodiment of the present disclosure in the lying position.
Figure 6:
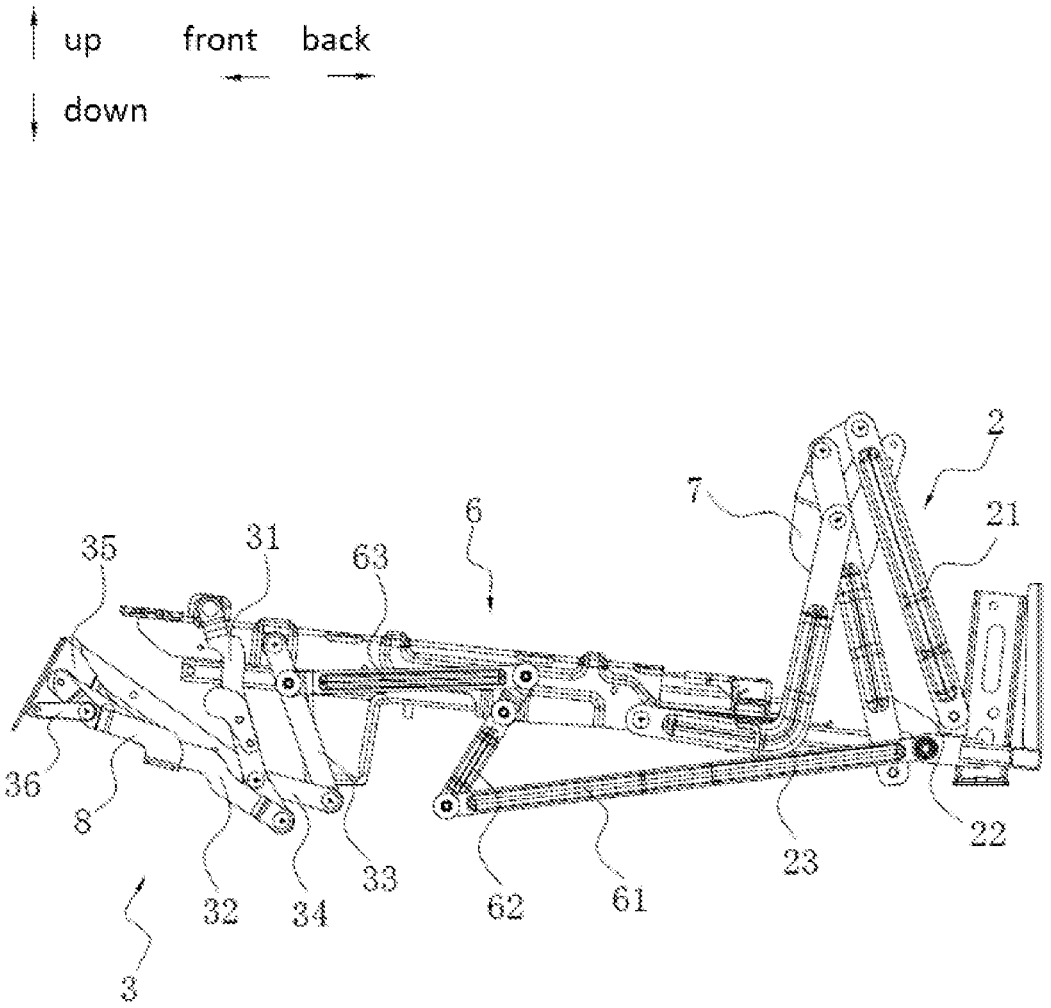
FIG. 6 shows schematically the structure of the coupling mechanism according to the second embodiment of the present disclosure in the intermediate position.

FIG. 4 to FIG. 6 exemplarily show the structure of the coupling mechanism according to the second embodiment of the present disclosure, which differs from the first embodiment in that the first coupling rod 61 is a long rod.

FIG. 4 shows schematically the structure of the coupling mechanism according to the present disclosure in the sitting position. In the sitting position, the linkage mechanism for leg rest 3 is retracted and located below the seat frame 1 and the carriage 4. The linkage assembly for backrest 2 is folded, so that it is approximately perpendicular to the seat frame 1.

FIG. 5 shows schematically the structure of the coupling mechanism of the present disclosure in the lying position. In the lying position, the linkage mechanism for leg rest 3 is rotated relative to the carriage 4 to move forward and upward away from the carriage 4, and the leg rest 8 is rotated upwardly relative to the second linkage for leg rest 32, so that it is approximately in the same plane as that of the holder 35. The linkage assembly for backrest 2 rotates relative to the seat frame 1 through the carriage 4, so that the backrest bracket 7 rotates from a state in which it is approximately perpendicular to the seat frame 1 to a state in which it inclines at an angle with the seat frame 1.

Referring to FIG. 6, there is an intermediate position between the sitting position and the lying position. In this intermediate position, the linkage mechanism for leg rest 3 is rotated upward and forward relative to the seat frame 1, but is not fully extended, and the leg rest 8 is not yet rotated and in a folded state relative to the second linkage for leg rest 32. When the linkage assembly for backrest 2 is rotated at an angle relative to the seat frame 1, the backrest bracket 7 is also rotated at an angle relative to the seat frame 1 through the linkage assembly for backrest 2. The first coupling rod 61, the second coupling rod 62 and the third coupling rod 63 of the coupling assembly 6 are articulated to each other to form a big Z-shape.

Referring to FIG. 5 and FIG. 6, the linkage mechanism for leg rest 3 also includes a first linkage for leg rest 31, a second linkage for leg rest 32, a third linkage for leg rest 33, a fourth linkage for leg rest 34, a holder 35 and a connecting rod 36, which is the same as in the first embodiment, furthermore, the structures and the connection manner of the linkage mechanism for leg rest 3, the leg rest 8 and the carriage 4 are also the same as in the first embodiment. The coupling assembly 6 includes a first coupling rod 61, a second coupling rod 62 and a third coupling rod 63, furthermore, the connecting structure is also approximately the same. The linkage assembly for backrest 2 also includes a first linkage for backrest 21, a second linkage for backrest 22 and a third linkage for backrest 23, furthermore, the structures and the connection manner of the linkage assembly for backrest 2, the backrest bracket 7 and the seat frame 1 are also the same. The driver 5 is also arranged between the seat frame 1 and the carriage 4.

Unlike the first embodiment, the first coupling rod 61 is configured as a long rod. While switching from the sitting position to the lying position, the rotation speed at which the linkage mechanism for leg rest 3 rotates forward and upward from the position below the seat frame 1 may be different. Depending on the design requirements, different structural solutions for the first coupling rod 61 can be selected.

Embodiment 3

Figure 7:
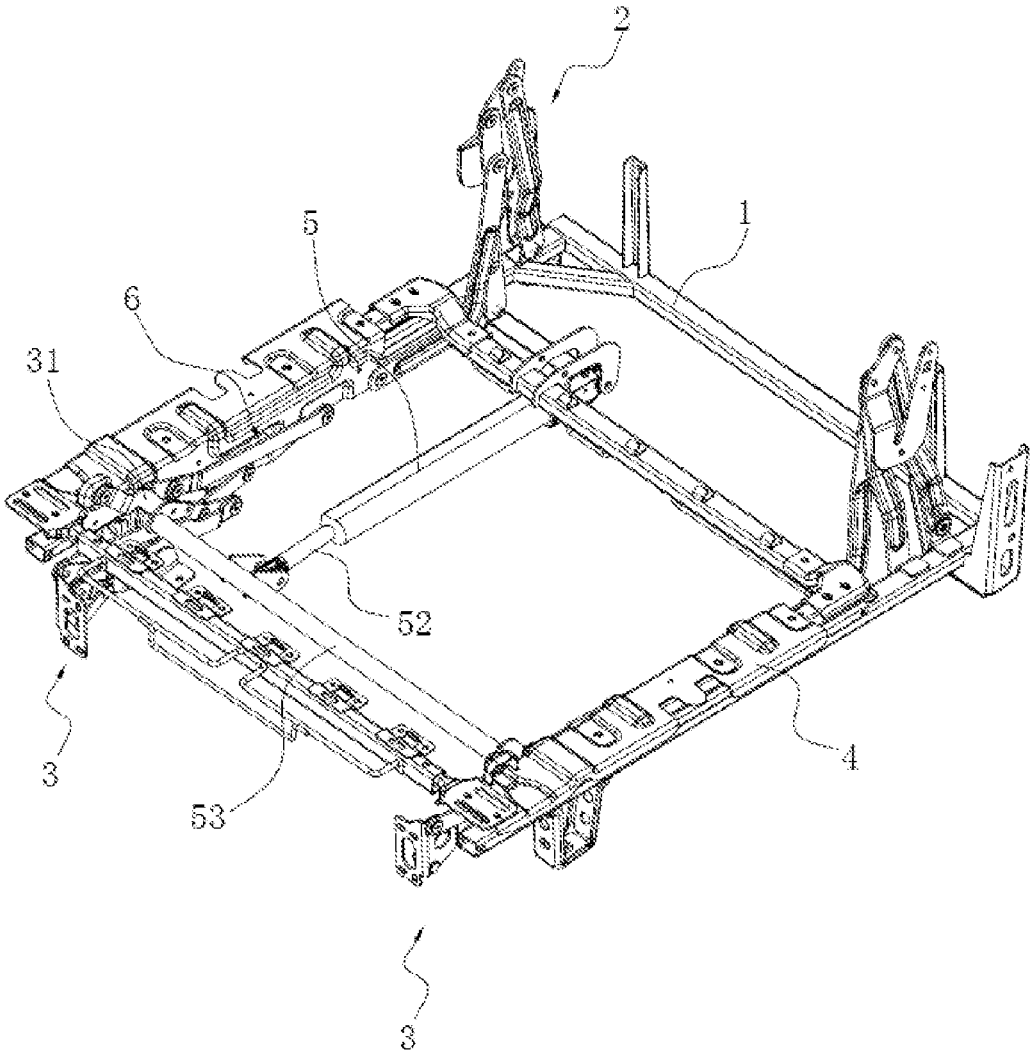
FIG. 7 shows schematically the structure of the coupling mechanism according to a third embodiment of the present disclosure in the sitting position.
Figure 8:
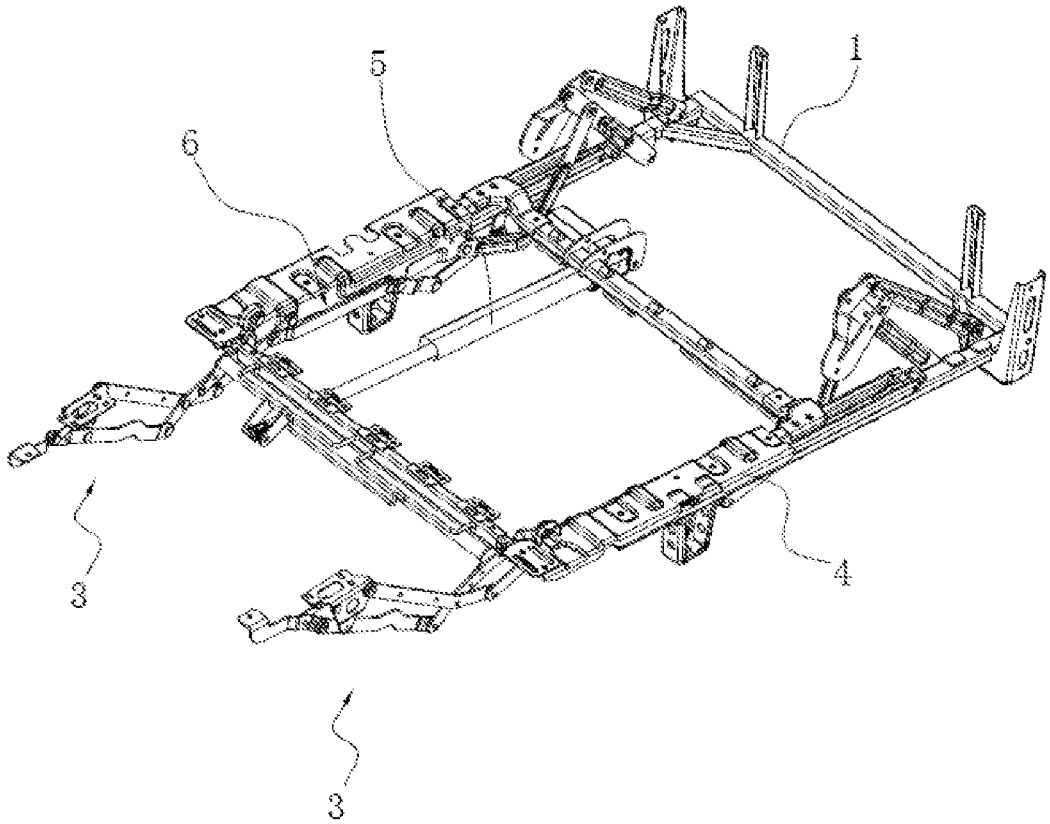
FIG. 8 shows schematically the structure of the coupling mechanism according to the third embodiment of the present disclosure in the lying position.
Figure 9:
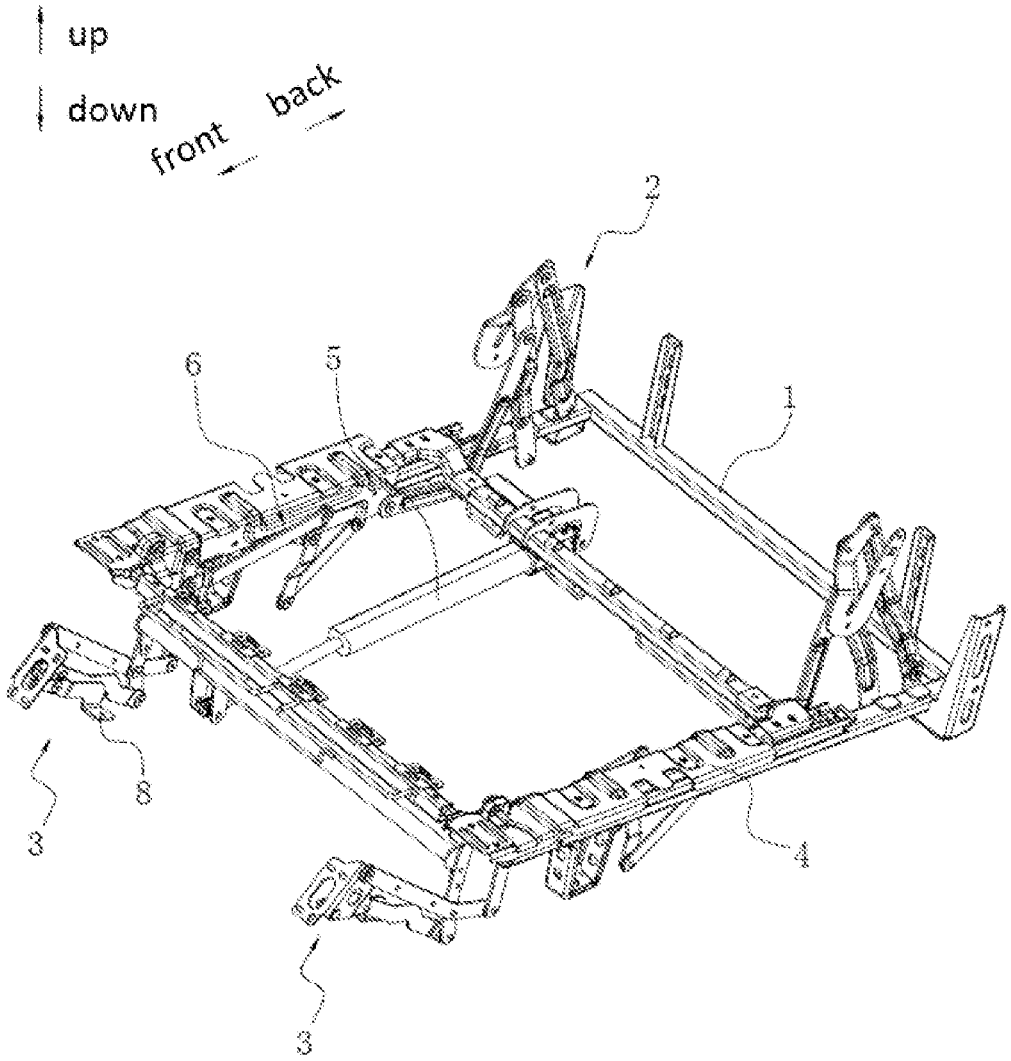
FIG. 9 shows schematically the structure of the coupling mechanism according to the third embodiment of the present disclosure in the intermediate position.

Referring to FIG. 7 to FIG. 9, the difference between this embodiment and the first embodiment is that the driver 5 is arranged between the carriage 4 and the linkage mechanism for leg rest 3. The driver 5 is connected to the linkage mechanism for leg rest 3 by the drive rod 53. In this embodiment, the drive rod 53 is fixedly connected to the first linkage for leg rest 31, and the drive end 52 of the driver 5 is eccentrically and pivotally connected to the drive rod 53. The driver 5 drives the linkage mechanism for leg rest 3 to move, such that the coupling assembly 6 is driven to move. Due to the movement of the coupling assembly 6, the carriage 4 moves relative to the seat frame 1, thus the linkage assembly for backrest 2 is driven to rotate, so that the leg rest 8 and the backrest bracket 7 can extend and retract synchronously.

FIG. 7 shows schematically the structure of the coupling mechanism according to the present disclosure in the sitting position. FIG. 8 shows schematically the structure of the coupling mechanism according to the present disclosure in the lying position. FIG. 9 shows schematically the structure of the coupling mechanism according to the present disclosure in the intermediate position. They are identical to those in the first embodiment and will not be described again.

Embodiment 4

Figure 10:
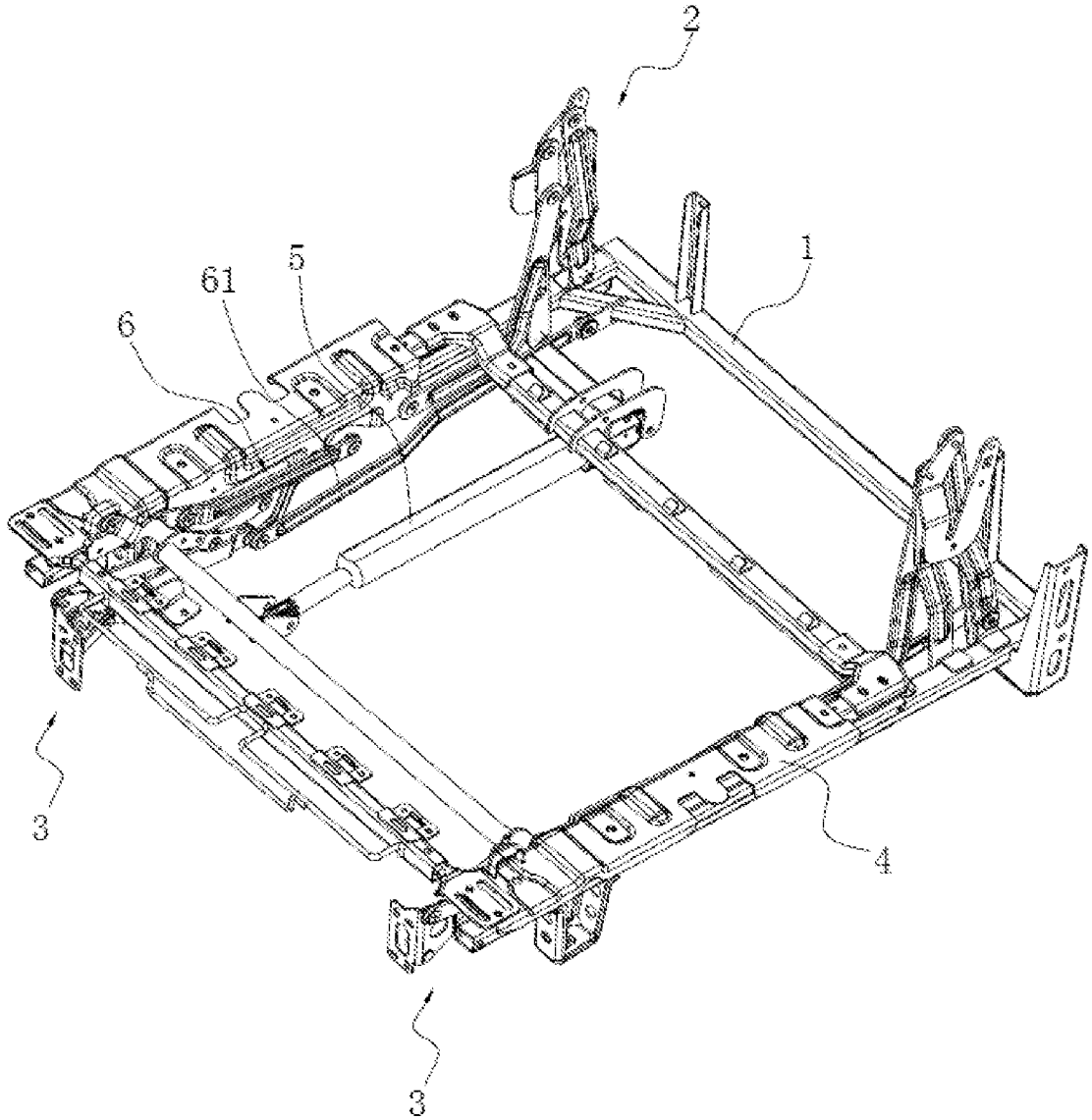
FIG. 10 shows schematically the structure of the coupling mechanism according to a fourth embodiment of the present disclosure in the sitting position.
Figure 11:
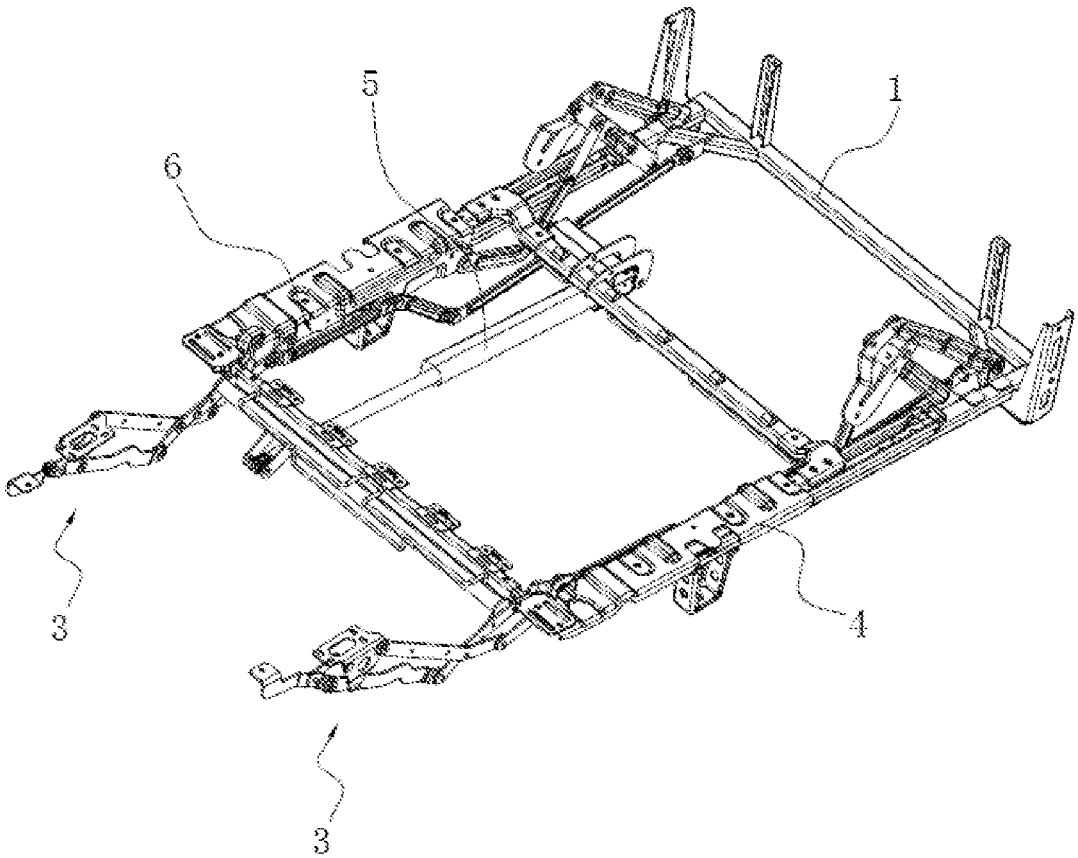
FIG. 11 shows schematically the structure of the coupling mechanism according to the fourth embodiment of the present disclosure in the lying position.

Referring to FIG. 10 and FIG. 11, the difference from the second embodiment is that the driver 5 is arranged between the carriage 4 and the linkage mechanism for leg rest 3. The difference from the third embodiment is that the first coupling rod 61 in the coupling assembly 6 is a long coupling rod.

FIG. 10 shows schematically the structure of the coupling mechanism according to the present disclosure in the sitting position. FIG. 11 shows schematically the structure of the coupling mechanism according to the present disclosure in the lying position. The sitting position, the lying position and the intermediate position of the coupling mechanism of this embodiment are identical to those in the third embodiment and will not be described again.

Embodiment 5

A seating furniture is provided in this embodiment, in particular a seat or a sofa, which includes the coupling mechanism according to one of the above embodiments.

The above shows and describes the basic principles, main features, and advantages of the present application. Those skilled in the art should understand that the present application is not limited by the aforementioned embodiments. The aforementioned embodiments and instructions only illustrate the principles of the present application. Without departing from the spirit and scope of the present application, there may be various changes, modifications, substitutions, and variations of the present application, all of which fall within the scope of the claimed protection.

LIST OF REFERENCE SIGNS

1 seat frame
2 linkage assembly for backrest
21 first linkage for backrest
22 second linkage for backrest
23 third linkage for backrest
3 linkage mechanism for leg rest
31 first linkage for leg rest
32 second linkage for leg rest
33 third linkage for leg rest
34 fourth linkage for leg rest
35 holder
36 connecting rod
4 carriage
5 driver
51 fixed end
52 drive end
53 drive rod
6 coupling assembly
61 first coupling rod
62 second coupling rod
63 third coupling rod
7 backrest bracket
8 leg rest

What is claimed is:

1. A coupling mechanism, comprising a seat frame, a leg rest and a backrest bracket, wherein the coupling mechanism further comprises:

a carriage slidably connected to the seat frame;

a linkage assembly for backrest, which is connected to the backrest bracket, the seat frame and the carriage, so that the backrest bracket is coupled to the carriage, so as to move relative to the seat frame;

a linkage mechanism for leg rest, which is connected to the carriage and the leg rest, so that the leg rest is configured to move toward or away from the carriage;

a coupling assembly rotationally connected to the carriage, two ends of the coupling assembly are respectively articulated to the seat frame and the linkage mechanism for leg rest; and a drive assembly connected to the carriage, to drive the leg rest and the backrest bracket to move relative to the seat frame;

wherein during operation of the drive assembly, the carriage slides relative to the seat frame, and the leg rest as well as the backrest bracket move and rotate relative to the seat frame, and the drive assembly is connected between the carriage and the seat frame, the drive assembly is configured to drive the carriage to move relative to the seat frame, and the leg rest and the backrest bracket are driven to move and rotate relative to the seat frame through the linkage mechanism for leg rest, the coupling assembly and the linkage assembly for backrest during movement of the carriage.

2. A coupling mechanism, comprising a seat frame, a leg rest and a backrest bracket, wherein the coupling mechanism further comprises:

a carriage slidably connected to the seat frame;

a linkage assembly for backrest, which is connected to the backrest bracket, the seat frame and the carriage, so that the backrest bracket is coupled to the carriage, so as to move relative to the seat frame;

a linkage mechanism for leg rest, which is connected to the carriage and the leg rest, so that the leg rest is configured to move toward or away from the carriage;

a coupling assembly rotationally connected to the carriage, two ends of the coupling assembly are respectively articulated to the seat frame and the linkage mechanism for leg rest; and a drive assembly connected to the carriage, to drive the leg rest and the backrest bracket to move relative to the seat frame;

wherein during operation of the drive assembly, the carriage slides relative to the seat frame, and the leg rest as well as the backrest bracket move and rotate relative to the seat frame, and the drive assembly is connected between the carriage and the linkage mechanism for leg rest, the drive assembly is configured to drive the linkage mechanism for leg rest to rotate relative to the carriage, and during rotation of the linkage mechanism for leg rest and by means of the coupling assembly and the linkage assembly for backrest, the carriage is driven to move relative to the seat frame, meanwhile the leg rest and the backrest bracket are driven to move and rotate relative to the seat frame.

3. The coupling mechanism according to claim 1, wherein the linkage assembly for backrest comprises a first linkage for backrest, a second linkage for backrest and a third linkage for backrest, two ends of the first linkage for backrest are respectively articulated to the backrest bracket and the seat frame, two ends of the second linkage for backrest are also respectively articulated to the backrest bracket and the seat frame, two ends of the third linkage for backrest are respectively articulated to the second linkage for backrest and the carriage, and the first linkage for backrest, the backrest bracket, the second linkage for backrest and the seat frame are articulated to each other to form a planar four-bar linkage.

4. The coupling mechanism according to claim 2, wherein the linkage assembly for backrest comprises a first linkage for backrest, a second linkage for backrest and a third linkage for backrest, two ends of the first linkage for backrest are respectively articulated to the backrest bracket and the seat frame, two ends of the second linkage for backrest are also respectively articulated to the backrest bracket and the seat frame, two ends of the third linkage for backrest are respectively articulated to the second linkage for backrest and the carriage, and the first linkage for backrest, the backrest bracket, the second linkage for backrest and the seat frame are articulated to each other to form a planar four-bar linkage.

5. The coupling mechanism according to claim 1, wherein the coupling assembly comprises a first coupling rod, a second coupling rod and a third coupling rod, the second coupling rod is articulated to the carriage, two ends of the second coupling rod are respectively articulated to the first coupling rod and the third coupling rod, an end of the first coupling rod facing away from the second coupling rod is articulated to the linkage assembly for backrest, and an end of the third coupling rod facing away from the second coupling rod is articulated to the linkage mechanism for leg rest.

6. The coupling mechanism according to claim 2, wherein the coupling assembly comprises a first coupling rod, a second coupling rod and a third coupling rod, the second coupling rod is articulated to the carriage, two ends of the second coupling rod are respectively articulated to the first coupling rod and the third coupling rod, an end of the first coupling rod facing away from the second coupling rod is articulated to the linkage assembly for backrest, and an end of the third coupling rod facing away from the second coupling rod is articulated to the linkage mechanism for leg rest.

7. The coupling mechanism according to claim 1, wherein the linkage mechanism for leg rest comprises a linkage assembly for leg rest, a holder and a connecting rod, two ends of the linkage assembly for leg rest are respectively articulated to the carriage and the holder, the leg rest is articulated to the linkage assembly for leg rest, and two ends of the connecting rod are respectively articulated to the holder and the leg rest.

8. The coupling mechanism according to claim 2, wherein the linkage mechanism for leg rest comprises a linkage assembly for leg rest, a holder and a connecting rod, two ends of the linkage assembly for leg rest are respectively articulated to the carriage and the holder, the leg rest is articulated to the linkage assembly for leg rest, and two ends of the connecting rod are respectively articulated to the holder and the leg rest.

9. The coupling mechanism according to claim 7, wherein the linkage assembly for leg rest comprises a first linkage for leg rest, a second linkage for leg rest, a third linkage for leg rest and a fourth linkage for leg rest, a first end of the first linkage for leg rest is articulated to the carriage, while a second end of the first linkage for leg rest is articulated to the second linkage for leg rest, an end of the second linkage for leg rest facing away from the first linkage for leg rest is articulated to an end of the leg rest at a first hinge point, a first end of the third linkage for leg rest is articulated to the carriage, while a second end of the third linkage for leg rest is articulated to the fourth linkage for leg rest, an end of the fourth linkage for leg rest facing away from the third linkage for leg rest is articulated to the holder, and the fourth linkage for leg rest is articulated at a point of the fourth linkage for leg rest between its two ends to a point of the first linkage for leg rest between its two ends.

10. The coupling mechanism according to claim 8, wherein the linkage assembly for leg rest comprises a first linkage for leg rest, a second linkage for leg rest, a third linkage for leg rest and a fourth linkage for leg rest, a first end of the first linkage for leg rest is articulated to the carriage, while a second end of the first linkage for leg rest is articulated to the second linkage for leg rest, an end of the second linkage for leg rest facing away from the first linkage for leg rest is articulated to an end of the leg rest at a first hinge point, a first end of the third linkage for leg rest is articulated to the carriage, while a second end of the third linkage for leg rest is articulated to the fourth linkage for leg rest, an end of the fourth linkage for leg rest facing away from the third linkage for leg rest is articulated to the holder, and the fourth linkage for leg rest is articulated at a point of the fourth linkage for leg rest between its two ends to a point of the first linkage for leg rest between its two ends.

11. The coupling mechanism according to claim 9, wherein the holder is further articulated to the second linkage for leg rest at a second hinge point, the second hinge point is close to the first hinge point between the leg rest and the second linkage for leg rest, a third hinge point between the connecting rod and the leg rest is close to the first hinge point between the leg rest and the second linkage for leg rest, and the holder, the connecting rod, the leg rest and the second linkage for leg rest are articulated to each other to form a planar four-bar linkage.

12. The coupling mechanism according to claim 10, wherein the holder is further articulated to the second linkage for leg rest at a second hinge point, the second hinge point is close to the first hinge point between the leg rest and the second linkage for leg rest, a third hinge point between the connecting rod and the leg rest is close to the first hinge point between the leg rest and the second linkage for leg rest, and the holder, the connecting rod, the leg rest and the second linkage for leg rest are articulated to each other to form a planar four-bar linkage.

13. The coupling mechanism according to claim 2, wherein the drive assembly comprises a driver and a drive rod, the driver is configured with a fixed end and a drive end, one of the fixed end or the drive end is connected to the carriage, while the other of the fixed end or the drive end is eccentrically articulated to the drive rod, and the drive rod is fixedly connected to the linkage mechanism for leg rest.

14. A seating furniture, comprising the coupling mechanism according to claim 2.

* * * * *